US009827759B2

(12) United States Patent
Doyle et al.

(10) Patent No.: US 9,827,759 B2
(45) Date of Patent: Nov. 28, 2017

(54) DRY PRINTING WITH SIMPLIFIED PLATE CLEANING

(71) Applicants: Alan Doyle, Hudson, NH (US); Travis Softic, Springfield, MA (US); Kevin Ray, Windham, NH (US)

(72) Inventors: Alan Doyle, Hudson, NH (US); Travis Softic, Springfield, MA (US); Kevin Ray, Windham, NH (US)

(73) Assignee: PRESSTEK, LLC, Hudson, NH (US)

( * ) Notice: Subject to any disclaimer, the term of this patent is extended or adjusted under 35 U.S.C. 154(b) by 0 days.

(21) Appl. No.: 15/246,762

(22) Filed: Aug. 25, 2016

(65) Prior Publication Data

US 2016/0361915 A1 Dec. 15, 2016

Related U.S. Application Data

(63) Continuation-in-part of application No. 13/214,475, filed on Aug. 22, 2011, which is a continuation-in-part of application No. 13/109,651, filed on May 17, 2011, now Pat. No. 8,967,043.

(51) Int. Cl.

| | |
|---|---|
| ***B41F 7/00*** | (2006.01) |
| ***B41C 1/10*** | (2006.01) |
| *B41N 1/00* | (2006.01) |
| *B41M 1/08* | (2006.01) |

(52) U.S. Cl.

CPC ..... *B41F 7/00* (2013.01); *B41C 1/1033* (2013.01); *B41C 2201/02* (2013.01); *B41C 2210/262* (2013.01); *B41M 1/08* (2013.01); *B41N 1/003* (2013.01)

(58) Field of Classification Search

CPC ..... B41F 35/06; B41F 7/00; B41C 1/1033; B41C 2210/262; B41M 1/08

See application file for complete search history.

(56) References Cited

U.S. PATENT DOCUMENTS

| | | | | |
|---|---|---|---|---|
| 5,163,368 | A * | 11/1992 | Pensavecchia | B41C 1/04 101/136 |
| 6,447,884 | B1 | 9/2002 | Burberry et al. | |
| 2002/0011167 | A1 | 1/2002 | Figov et al. | |
| 2002/0108519 | A1 | 8/2002 | Friedman | |
| 2004/0224256 | A1* | 11/2004 | Figov | B41C 1/1008 430/270.1 |
| 2011/0174178 | A1 | 7/2011 | Adamson et al. | |

FOREIGN PATENT DOCUMENTS

| | | | |
|---|---|---|---|
| JP | 2001305725 | A | 11/2001 |
| JP | 2001330945 | A | 11/2001 |

* cited by examiner

*Primary Examiner* — Blake A Tankersley
*Assistant Examiner* — Quang X Nguyen
(74) *Attorney, Agent, or Firm* — Morgan, Lewis & Bockius LLP

(57) ABSTRACT

The blanket cylinder of a printing press is used to remove oleophobic debris from an imaged dry printing member. Following imaging—e.g., imagewise exposure of the printing member to radiation that ablates the layer below the oleophobic layer, or de-anchors it from the oleophobic layer without ablation—the printing member is brought into rolling contact with the blanket cylinder, and the press is operated "on impression." This rolling contact may remove not only the oleophobic top layer but ablation debris of the underlying imaging layer as well.

15 Claims, 2 Drawing Sheets

DRY PRINTING WITH SIMPLIFIED PLATE CLEANING

RELATED APPLICATION

This is a continuation-in-part of U.S. Ser. No. 13/214,475, filed on Aug. 22, 2011, which is itself a continuation-in-part of U.S. Ser. No. 13/109,651, filed on May 17, 2011; the entire disclosures of these documents are hereby incorporated by reference. In addition, the contents of U.S. Ser. Nos. 13/295,300 and 13/591,946 are hereby incorporated by reference.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

To circumvent the cumbersome photographic development, plate-mounting, and plate-registration operations that typify traditional printing technologies, practitioners have developed electronic alternatives that store the imagewise pattern in digital form and impress the pattern directly onto the plate. Plate-imaging devices amenable to computer control include various forms of lasers.

Dry plates, which utilize an oleophobic topmost layer of fluoropolymer or, more commonly, silicone (polydiorganosiloxane), exhibit excellent debris-trapping properties because the topmost layer is tough and rubbery; ablation debris generated thereunder remains confined as the silicone or fluoropolymer does not itself ablate. Where imaged, the underlying layer is destroyed or de-anchored from the topmost layer. A common three-layer plate, for example, is made ready for press use by image-wise exposure to imaging (e.g., infrared or "IR") radiation that causes ablation of all or part of the central layer, leaving the topmost layer de-anchored in the exposed areas. Subsequently, the de-anchored overlying layer and the central layer are removed (at least partially in the case of the second layer) to reveal the third layer (typically an oleophilic polymer, such as polyester).

The de-anchored oleophobic layer may be removed manually, by rubbing with a cloth, or by an automated cleaning apparatus involving brushes, belts or the like. In either case, the procedure interrupts the sequence of imaging and printing when the plate is imaged on-press, often requiring disengagement of the plate cylinder in the case of manual cleaning. Formulating the oleophobic layer for toughness in order to withstand the rigors of commercial printing means that its removal, even when de-anchored, will require a corresponding degree of effort. Automated cleaning, while more convenient, requires additional equipment and consequent expense, maintenance, and power consumption.

Accordingly, there is an ongoing need for improvements in plate design that preserve durability but mitigate cleaning requirements.

SUMMARY OF THE INVENTION

It has been found, surprisingly, that the blanket cylinder of a printing press can itself remove oleophobic debris from an imaged dry printing member. (By "debris" is meant those portions of one or more layers of the printing member that have been de-anchored, by the imaging process, from an adjacent layer.) Thus, following imaging—e.g., imagewise exposure of the printing member to radiation that ablates the layer below the oleophobic layer, or de-anchors it from the oleophobic layer without ablation—the printing member is brought into rolling contact with the blanket cylinder (with the blanket, which is typically rubber, present thereon). The press inking system is engaged without ink (i.e., the press is operated "on impression"). This rolling contact may remove not only the oleophobic top layer but ablation debris of the underlying imaging layer; and since the imaging layer is typically oleophilic, its complete removal is unnecessary for printing.

The result is surprising because, first, silicones and fluoropolymers have very low surface energies (typically on the order of 20 $mJ/m^2$), which make them ideal for repelling ink; second, the top layer is very tough for durability; and third, there is little tangential force applied to the printing member by the blanket cylinder (since it is geared with the impression cylinder, with which it is in rolling contact). Further surprisingly, the procedure is ineffective if ink is present at the plate surface—that is, both the blanket and the oleophobic surface should be substantially free of ink.

Accordingly, in a first aspect, the invention pertains to a method of printing with an ablation-type printing member comprising (i) an oleophilic substrate, (ii) over and in contact with the substrate, an ablatable imaging layer, and (iii) over and in contact with the imaging layer, a cured oleophobic polymer composition. In various embodiments, the method comprises the steps of (a) exposing the printing member to imaging radiation in an imagewise pattern, the imaging radiation at least partially ablating the imaging layer where exposed; and (b) with the printing member on a printing press comprising (i) a plate cylinder for retaining the printing member, (ii) an inking system for transferring ink to the printing member on the plate cylinder, (iii) an impression cylinder for retaining a recording medium, and (iv) a blanket cylinder engageable to rolling contact with the plate cylinder and the impression cylinder for transferring ink from the plate to the recording medium, operating the press in an on impression mode to engage the blanket cylinder but not engage the inking system, whereby the blanket cylinder is brought into repeated contact with the uninked printing member so as to remove ablation debris therefrom and thereby create an imagewise lithographic pattern thereon, rendering the printing member suitable for printing; and (c) thereafter, engaging the inking system to cause transfer of ink to the printing member and thereafter from the printing member to a recording medium, via the blanket cylinder, in the imagewise pattern.

Typically, the blanket cylinder will have a rubber surface. In some embodiments the cured oleophobic surface is a silicone, whereas in other embodiments, the cured oleophobic surface is a fluoropolymer. The method may further comprise the step of cleaning the blanket cylinder following step (b) but prior to step (c), followed by air drying.

In some embodiments, the ablatable imaging layer has (A) a single crosslinked polymer network consisting essentially of a melamine component and a resole component, the resole component being present in an amount ranging from 0% to 28% by weight of dry film, wherein the single crosslinked polymer network is the only crosslinked polymer network in the oleophilic resin composition, (B) dispersed within the crosslinked polymer network, a near-IR absorber, and (C) a dry coating weight in the range of 1.0 to 2.5 $g/m^2$. The imaging layer may, in some embodiments, contain no resole resin. The near-IR absorber may comprise, consist of, or consist essentially of a dye. The near-IR absorber may constitutes at least 20% or at least 30% of the imaging layer by weight of dry film. The melamine resin may constitute no more than 88% of the imaging layer by weight. The oleophobic third layer may have a dry coating weight of less than 2.0 $g/m^2$ and, in some embodiments, less than 0.5 $g/m^2$. The oleophilic first layer may be an aluminum sheet, e.g., a grained and anodized aluminum sheet.

As used herein, the term "plate" or "member" refers to any type of printing member or surface capable of recording an image defined by regions exhibiting differential affinities for ink and/or fountain solution. Suitable configurations include the traditional planar or curved lithographic plates that are mounted on the plate cylinder of a printing press, but can also include seamless cylinders (e.g., the roll surface of a plate cylinder), an endless belt, or other arrangement.

"Ablation" of a layer means either rapid phase transformation (e.g., vaporization) or catastrophic thermal overload, resulting in uniform layer decomposition. Typically, decomposition products are primarily gaseous. Optimal ablation involves substantially complete thermal decomposition (or pyrolysis) with limited melting or formation of solid decomposition products.

The terms "substantially" and "approximately" mean±10% (e.g., by weight or by volume), and in some embodiments, ±5%. The term "consists essentially of" means excluding other materials that contribute to function or structure. For example, a resin phase consisting essentially of a melamine resin and a resole resin may include other ingredients, such as a catalyst, that may perform important functions but do not constitute part of the polymer structure of the resin. Percentages refer to weight percentages unless otherwise indicated.

DESCRIPTION OF DRAWINGS

The foregoing discussion will be understood more readily from the following detailed description of the invention, when taken in conjunction with the accompanying drawings, in which.

DETAILED DESCRIPTION

1. Representative Press Environment

Figure 1:
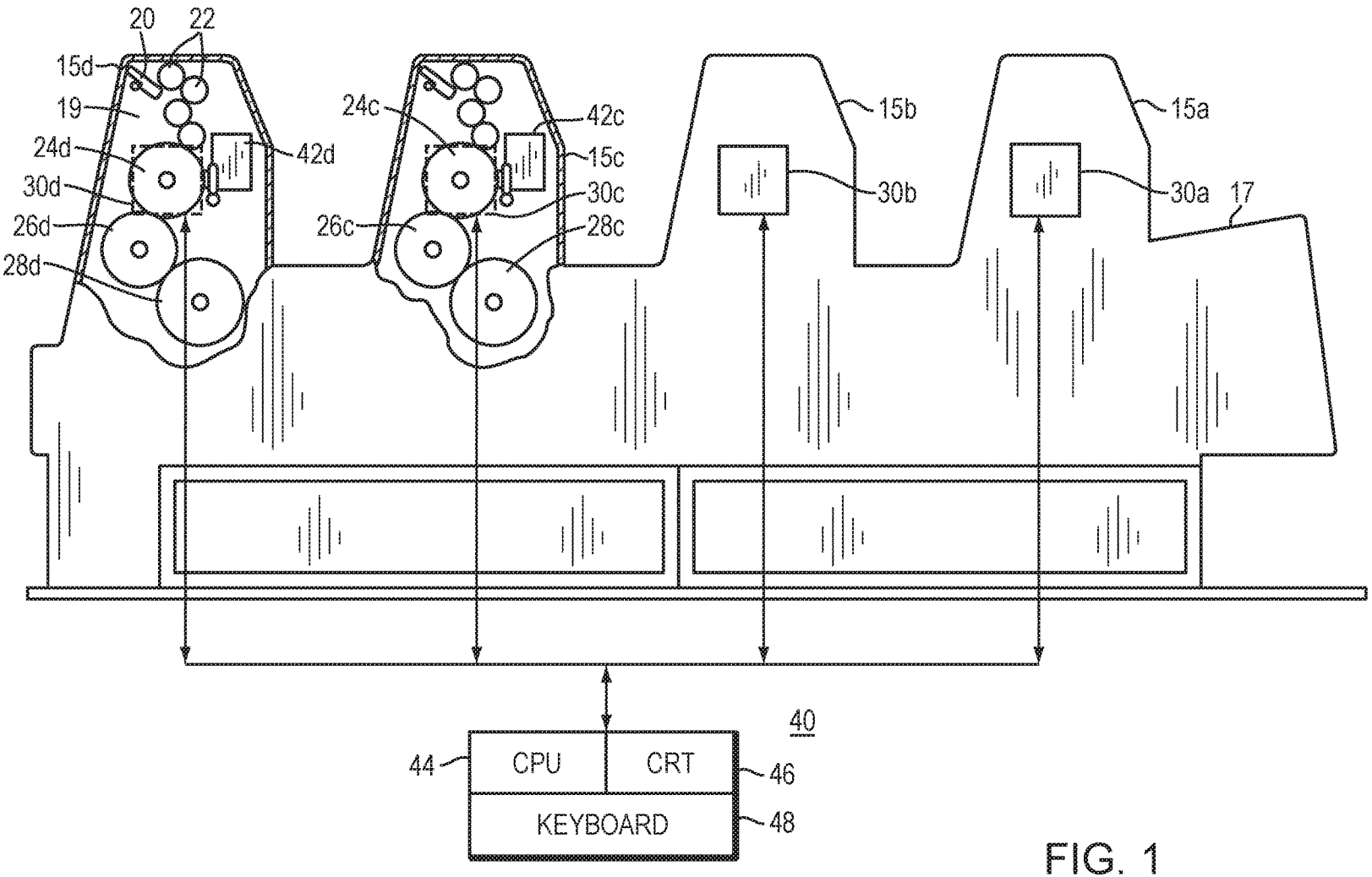
FIG. 1 is a side elevational and schematic view of a waterless offset color press.

Refer first to FIG. 1, which is a side elevational view of a conventional in-line, waterless press with cutaway views of two print towers. The press comprises a series of four print stations or towers 15*a*, 15*b*, 15*c* and 15*d*, each of which contains the necessary equipment (described below) to apply ink or lacquer to a recording material. Although four print stations are illustrated, it should be understood that conventional presses can contain as few as one or as many as 10 or more such stations, depending on the nature of the printing to be performed.

Individual sheets of recording material are fed to the print stations from a tray 17 at the right side of the press as viewed in FIG. 1. A conventional handling mechanism (not shown) draws the topmost sheet from tray 17 and carries it to the first print station 15*a*, where it is wrapped around an impression cylinder and inked. Thereafter, the sheet is stripped from this impression cylinder and carried to the second print station 15*b* where a similar operation is performed, and so on. The handling mechanism maintains registration and alignment of the material as it is transported across the press, and may contain a "perfection" assembly that turns the sheet upside down between print stations for two-sided printing.

The cutaway view of FIG. 1 illustrates the components of two representative print stations 15*c*, 15*d*, both configured for dry printing. The stations 15*c*, 15*d* include an ink fountain assembly 19 that comprises an ink tray 20, which transfers ink via a series of rollers 22, and means for automatically controlling ink flow so that the amount and distribution of ink can be regulated electronically. The rollers 22 transfer ink to the surface of a plate cylinder 24*d*, which makes surface contact with a blanket cylinder 26*d* of the same diameter, and that cylinder, in turn, is in surface contact with an impression cylinder 28*d*. The print station 15*d* also includes a controller, shown in phantom at 30*d*, which monitors the angular position of plate cylinder 24*d* and also furnishes ink-control signals to ink fountain assembly 19. Suitable controllers are well-known in the art (see, e.g., U.S. Pat. Nos. 4,911,075 and 5,163,368, the entire disclosures of which is hereby incorporated by reference). The press can also be configured to print webs of recording material by addition of suitable feeding equipment on the intake side of the press (in lieu of tray 17), and complementary uptake equipment on the output side.

The printing stations are equipped with on-press imaging systems, indicated by reference numerals 42*c* and 42*d*. These are described in greater detail below. The press also includes a computer, shown schematically at 40, which facilitates operation of the press as well as the on-press imaging systems, transferring image data and control signals to controllers 30*a*, 30*b*, 30*c* and 30*d*. The controllers respond to digital signals, supplied by computer 40, that represent an original document or image. Connections between computer 40 and the controllers are provided by suitable cables.

Computer 40 comprises a central-processing unit (CPU) 44, which stores, retrieves and manipulates data; a display 46 for communication with the operator; and a keyboard and/or other input device(s) 48, with which the operator enters data and control commands. Computer 40 may be a single machine or a set of processors configured to operate in parallel, thereby dividing the workload and increasing the effective processing speed. The computer may include one or more mass-storage devices, such as disks, to hold the typically large quantities of data associated with digitized images.

Using keyboard 48, the operator may enter instructions for imaging the printing plates on-press, registration information, and/or instructions relating to press control such as ink-flow adjustment, number of copies to be printed, etc. Press settings include engage blanket (i.e., bring the blanket cylinder 26 into rolling engagement with plate cylinder 24 and impression cylinder 28), feed ink to inking rollers and engage them with the plate cylinder 24, feed paper through the press, and combinations of the foregoing. When the press is in the "on impression" mode, the blanket is in contact with the plate cylinder, but ink is not present at the plate surface, and the ink rollers 22 are not operational (though they do carry ink). When all systems are operational and paper is fed through the press, it is said to operate "on print."

2. Representative Printing Plates

Figure 2:
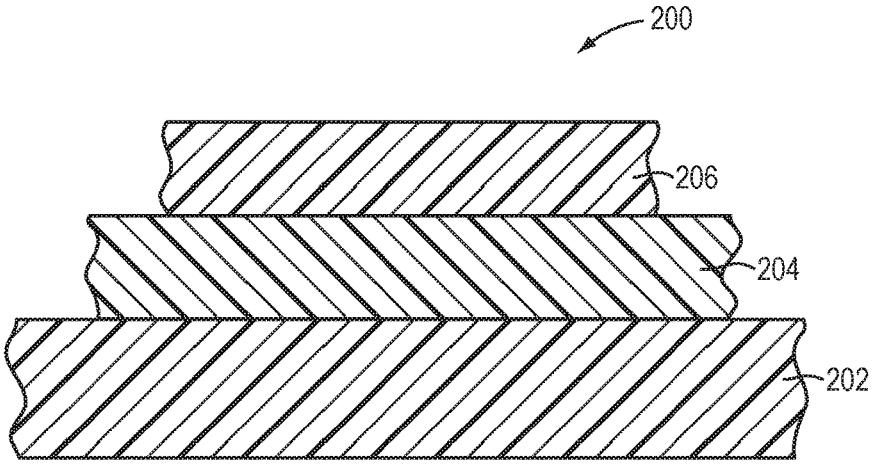
FIG. 2 is an enlarged cross-sectional view of a printing member useful in connection with the present invention.

The approach to plate cleaning and use described herein is applicable across many dry plate systems having silicone or fluoropolymer topmost layers. FIG. 2A illustrates a negative-working printing member 200 that may be imaged and printed according to the present invention. The printing member 200 includes a metal or polymeric substrate 202, an imaging layer 204, and a topmost layer 206. Layer 204 is sensitive to imaging (generally IR) radiation as discussed below, and imaging of the printing member 200 (by exposure to IR radiation) results in imagewise ablation of the layer 204. The resulting de-anchorage of topmost layer 206 facilitates its removal as described herein. Substrate 202 (or a layer thereover) exhibits a lithographic affinity opposite that of topmost layer 206. Consequently, ablation of layer 204, followed by imagewise removal of the layer 106 to reveal an underlying layer or the substrate 202, results in a lithographic image.

Most of the films used in the present invention are "continuous" in the sense that the underlying surface is completely covered with a uniform layer of the deposited material. Each of these layers and their functions is described in detail below.

2.1 Layer 202

When serving as a substrate, layer 202 provides dimensionally stable mechanical support to the printing member. The substrate should be strong, stable, and flexible. One or more surfaces (and, in some cases, bulk components) of the substrate may be hydrophilic. The topmost surface, however, is generally oleophilic. Suitable materials may be metal or polymeric in nature. As used herein, the term "substrate" refers generically to the ink-accepting layer beneath the radiation-sensitive layer 204, although the substrate may, in fact, include multiple layers (e.g., an oleophilic film laminated to an optional metal support, such as an aluminum sheet having a thickness of at least 0.001 inch, or an oleophilic coating over an optional paper support). Thus, a polymeric substrate may be a bulk polymer or polymer layer applied over a metal or paper support.

Various embodiments of the present invention utilize metal substrates, e.g., an anodized aluminum sheet; although such substrates have hydrophilic surfaces that make them suitable for wet plates, the surface is also oleophilic, making it suitable for the present usage. In one embodiment, substrate 202 is a 200 μm (0.008 inch) anodized aluminum sheet (1052 aluminum alloy, electrochemically etched and anodized to give an anodic layer with Ra values in the order of 0.300 μm).

Heat dissipation must be considered when using a metal substrate, since metal is such a good conductor of heat; if too much laser energy is lost into the substrate, the imaging layer will not ablate. One approach is to use a sufficiently thick imaging layer (e.g., 1.3 $g/m^2$ for an aluminum substrate, as compared with 0.5 $g/m^2$ with a polyester substrate). At sufficient thicknesses, heat remains concentrated within the upper region of the imaging layer and ablates only a fraction of the thickness; in effect, the remainder of the layer provides insulation against heat dissipation. So long as the imaging layer is oleophilic, it can serve as an ink receptor. Moreover, since the underlying metal substrate is also oleophilic, the imaging layer need not be particularly durable—i.e., it does not matter whether it wears away during use, since the underlying layer will provide the ink-accepting lithographic function. A sufficiently high laser power (and/or sufficiently slow imaging speeds) can facilitate use of a thinner imaging layer, since sufficient energy for ablation will be imparted notwithstanding dissipation of some laser energy into the metal substrate.

Substrate 202 desirably also desirably exhibits high scattering with respect to imaging radiation. This allows full utilization of the radiation transmitted through overlying layers, as the scattering causes back-reflection into layer 204 and consequent increases in thermal efficiency. Polymers suitable for use in substrates according to the invention include, but are not limited to, polyesters (e.g., polyethylene terephthalate and polyethylene naphthalate), polycarbonates, polyurethane, acrylic polymers, polyamide polymers, phenolic polymers, polysulfones, polystyrene, and cellulose acetate. A preferred polymeric substrate is polyethylene terephthalate film, such as the polyester films available from DuPont-Teijin Films, Hopewell, Va. under the trademarks MYLAR and MELINEX, for example. Also suitable are the white polyester products from DuPont-Teijin such as MELINEX 927W, 928W 329, 329S, 331. Suitable substrates include polyethylene terephthalate, polyethylene naphthalate and polyester laminated to an aluminum sheet. Substrates may be coated with a subbing layer to improve adhesion to subsequently applied layers.

For example, polymeric substrates can be coated with a hard polymer transition layer to improve the mechanical strength and durability of the substrate and/or to alter the hydrophilicity or oleophilicity of the surface of the substrate. Ultraviolet- or EB-cured acrylate coatings, for example, are suitable for this purpose. Polymeric substrates can have thicknesses ranging from about 50 μm to about 500 μm or more, depending on the specific printing member application. For printing members in the form of rolls, thicknesses of about 200 μm are preferred. For printing members that include transition layers, polymer substrates having thicknesses of about 50 μm to about 100 μm are preferred.

2.2 Layer 204

Layer 204 ablates in response to imaging radiation, typically near-IR radiation. In general, layer 204 has a cured resin phase consisting essentially of a melamine resin and, in some embodiments, a resole resin, the latter being present in an amount ranging from 0% to 28% by weight of dry film. A near-IR absorber—typically a dye—is dispersed within the cured resin phase.

The term "resole resin" refers to the the reaction of phenol with an aldehyde (usually formaldehyde) under alkali conditions with an excess of formaldehyde. The molar ratio of phenol to aldehyde is typically 1:1.1 to 1:3, and the excess formaldehyde causes the resulting polymer to have many $CH_2OH$ (methylol) pendant groups. This distinguishes resoles from other phenolic resins (including phenol formaldehyde resins such as novolaks, which are prepared under acidic conditions with an excess of phenol rather than aldehyde).

Suitable melamine resins are methylated, low-methylol, high-imino melamines having a viscosity ranging from 7000 to 15,000 centipoises at 23° C., or a viscosity ranging from 1000 to 1600 centipoises at 23° C. Suitable melamine resins include methylated, low-methylol, high-imino melamine materials, for example CYMEL cross-linkers from Cytek Industries, Inc. The melamine resin loading is typically between 30 and 70% by weight of the imaging layer.

For proper printing performance following mechanical cleaning, imaging layers having dry coating weights from 1.0 to 2.5 g/m$^2$, and especially from about 1.0 g/m$^2$ to 2.0 g/m$^2$, are preferred. Because the imaging layer is oleophilic it need not be fully removed. In various embodiments, ablatability is achieved at a fluence of 400, 300, 250, or 200 mJ/cm$^2$ or less, with 200 mJ/cm$^2$ being preferred. The ablation threshold is dictated primarily by layer thickness and the loading level and efficiency of the absorber. In the embodiments described herein, the absorbing dye is present at a loading level of at least 20%, and preferably more than 30%, by weight of dry film.

2.3 Silicone Layer 206

The topmost layer participates in printing and provides the requisite lithographic affinity difference with respect to substrate 202; in particular, layer 206 is oleophobic and suitable for dry printing. In addition, the topmost layer 206 may help to control the imaging process by modifying the heat dissipation characteristics of the printing member at the air-imaging layer interface.

Layer 106 is a silicone or fluoropolymer. Silicones are based on the repeating diorganosiloxane unit $(R_2SiO)_n$, where R is an organic radical or hydrogen and n denotes the number of units in the polymer chain. Fluorosilicone polymers are a particular type of silicone polymer wherein at least a portion of the R groups contain one or more fluorine atoms. The physical properties of a particular silicone polymer depend upon the length of its polymer chain, the nature of its R groups, and the terminal groups on the end of its polymer chain. Any suitable silicone polymer known in the art may be incorporated into or used for the surface layer. Silicone polymers are typically prepared by crosslinking (or "curing") diorganosiloxane units to form polymer chains. The resulting silicone polymers can be linear or branched. A number of curing techniques are well known in the art, including condensation curing, addition curing, moisture curing. In addition, silicone polymers can include one or more additives, such as adhesion modifiers, rheology modifiers, colorants, and radiation-absorbing pigments, for example. Other options include silicone acrylate monomers, i.e., modified silicone molecules that incorporate "free radical" reactive acrylate groups or "cationic acid" reactive epoxy groups along and/or at the ends of the silicone polymer backbone. These are cured by exposure to UV and electron radiation sources. This type of silicone polymer can also include additives such as adhesion promoters, acrylate diluents, and multifunctional acrylate monomer to promote abrasion resistance, for example.

In preferred embodiments, the silicone layer is formed from a polymethylhydrosiloxane polymer, copolymer or polymer blend (a silane cross-linking agent having —Si—H groups), and a vinyl-functional polydimethylsiloxane polymer, copolymer or polymer blend. Typically the silicone is formed from an addition-cure hydrosilylation reaction using a platinum catalyst such as elemental platinum, platinum chloride, chloroplatinic acid, olefin coordinated platinum, an alcohol modified complex of platinum, or a methylvinyl polysiloxane complex of platinum. The vinyl-functional polydimethylsiloxane is vinyl-terminated. The polymethylhydrosiloxane polymer is trimethylsiloxy-terminated.

The silicone layer may have a dry coating weight of, for example, less than 2.0 g/m$^2$, less than 1.0 g/m$^2$, and preferably less than 0.5 g/m$^2$.

3. Imaging and Printing

Imaging of the printing member 200 may take place directly on a press as shown in FIG. 1, or on a platemaker. In general, the imaging apparatus will include at least one laser device that emits in the region of maximum plate responsiveness, i.e., whose $\lambda_{max}$ closely approximates the wavelength region where the plate absorbs most strongly. Specifications for lasers that emit in the near-IR region are fully described in U.S. Pat. No. Re. 33,512 ("the '512 patent") and U.S. Pat. No. 5,385,092 ("the '092 patent"), the entire disclosures of which are hereby incorporated by reference. Lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

Other imaging systems, such as those involving light valving and similar arrangements, can also be employed; see, e.g., U.S. Pat. Nos. 4,577,932; 5,517,359; 5,802,034; and 5,861,992, the entire disclosures of which are hereby incorporated by reference. Moreover, it should also be noted that image dots may be applied in an adjacent or in an overlapping fashion. The imaging apparatus can be configured as a flatbed recorder or as a drum recorder, with the lithographic plate blank mounted to the interior or exterior cylindrical surface of the drum.

Following imaging but before printing begins, the printing member is brought into rolling contact with the blanket without ink present for, e.g., around 30 seconds. The deanchored coating material attaches to the blanket, after which it can be either wiped away or deposited onto the start-up printed waste or leader paper.

It is found that beneficial results are obtained only if the blanket is free of ink when it engages the imaged printing member, and furthermore that without this step, the printing member will not perform properly without conventional cleaning:

| Ink and ink rollers | Blanket engaged? | Result |
|---|---|---|
| Off | Yes | Silicone sticks to blanket: pass |
| On | No | Silicone migrates though inking system and becomes a pain to clean out of press: fail |
| On | Yes | A little silicone sticks to blanket, most impresses back on plate: fail |
| Off | No | Plate does not develop, silicone is not removed: fail |

That is, printing without either prior conventional cleaning or subjection to an ink-free blanket cylinder as described herein will result in unacceptable performance. Hence, if necessary, the blanket may be cleaned of any residual ink prior to engagement with the imaged printing member.

The ink-free blanket will typically remove 75% of the oleophobic layer where the printing member has been imaged. Removal is especially effective in 100% imaged areas and tonal regions comprising from 75 to 99% dots ("shadow" regions) and mid-tones (25 to 75% dots). Following the optional cleaning step, the blanket will remove additional oleophobic material from imaged areas once normal printing begins. In this case, removal is especially effective in the highlight regions (comprising 1 to 25% dots).

Optionally, the blanket may be cleaned (e.g., using isopropyl alcohol and wiping with a rag) before allowing ink to enter the inking system and transfer to the blanket cylinder, but after subjecting the printing member to the ink-free blanket cylinder. This optional cleaning step is followed by air drying for five seconds or less, typically about two seconds.

EXAMPLES

Example 1

This example describes a negative-working, waterless printing plate that may be developed on-press, and comprising a thin, oleophobic silicone layer, disposed on an imaging layer, itself composed of infrared absorbing dye and a polymer, disposed on an aluminum sheet. The sheet is a 1052 aluminum alloy, electrochemically etched and anodized to provide an anodic layer with Ra values in the order of 0.3 μm.

The formulation given in the following table was used for the infrared-absorbing imaging layer.

| Components | Parts by Weight Example 1 |
|---|---|
| Cymel 303 Resin | 8.21 |
| S0094 NIR Dye | 3.44 |
| Lubrizol 2062 | 0.08 |
| Walsroder E 400 NC | 2.85 |
| Cycat 4040 | 0.66 |
| BYK 307 | 0.20 |
| Dowanol PM | 71.77 |
| nMP | 12.79 |

CYMEL 303 is a highly methylated, monomeric melamine resin supplied at 98% solids by Cytek Industries, Inc. This resin has a reported viscosity in the range of 3000 cps to 6000 cps. CYCAT 4040 is a general purpose, p-toluenesulfonic acid catalyst supplied as a 40% solution in isopropanol by Cytek Industries, Inc. Walsroder E 400 NC is a nitrocellulose damped with 30% IPA purchased from Dow Chemical. BYK 307 is a polyether-modified polydimethylsiloxane surfactant supplied by BYK Chemie. DOWANOL PM is propylene glycol methyl ether available from the Dow Chemical. nMP is N-methyl-2-pyrrolidone, available from Dow Chemical. S0094 is a cyanine near IR dye manufactured by FEW Chemicals GmbH, Bitterfeld-Wolfen, Germany. LUBRIZOL 2062 is supplied by Lubrizol Corporation of Wickliffe, Ohio.

The coating solution was applied to the aluminum substrate using a #7 wire-wound metering rod and then was dried and cured at 138° C. (temperature set on the oven dial) to produce a dried coating of coat weight 1.4 g/m$^2$. The coat weight was measured gravimetrically on samples prepared with a formulation without catalyst. Drying and curing were carried out on a belt conveyor oven, SPC Mini EV 48/121, manufactured by Wisconsin Oven Corporation (East Troy, Wis.). The conveyor was operated at a speed of 3.2 feet/minute (which gives a dwell time of about 40 seconds in the air-heated zone of the oven).

The oleophobic silicone top layer was subsequently disposed on the imaging layer using the formulation given below. The silicone layer is a highly cross-linked network structure produced via the addition or hydrosilylation reaction between the vinyl groups (SiVi) of vinyl-terminated functional silicone and the silyl (SiH) groups of trimethylsiloxy-terminated poly(hydrogen methyl siloxane) crosslinker, in the presence of a Pt catalyst complex and an inhibitor.

| Component | Parts by Weight Example 1 |
|---|---|
| PLY-3 7500P | 12.40 |
| DC Syl Off 7367 Crosslinker | 0.53 |
| CPC 072 Pt Catalyst | 0.17 |
| Heptane | 86.9 |

PLY-3 7500P is an end-terminated vinyl functional silicone resin, with average molecular weight 62,700 g/mol, supplied by Nusil Silicone Technologies, Carpinteria, Calif. DC SYL OFF 7367 is a trimethylsiloxy-terminated poly (hydrogen methylsiloxane) crosslinker manufactured by Dow Corning Silicones (Auburn, Mich.), which is supplied as a 100% solids solution containing about 30% of 1-ethynylcyclohexane which functions as catalyst inhibitor. CPC 072 is a 1,3 diethyenyl-1,1,3,3-tetramethyldisiloxane Pt complex catalyst manufactured by Umicore Precious Metals (Hoboken-Antwerp, Belgium), which is supplied as a 3% xylene solution. Printing-plate precursors were imaged on a Kodak TRENDSETTER image setter, operating at a wavelength of 830 nm, available from Eastman Kodak.

A Heidelberg GTO 52 press, single color unit with automatic feed was used in the experiments conducted. The ink used was Toyo King Aqualess Ultra Black MZUS as supplied by Toyo Ink, South Plainfield, N.J. The press blanket used was a Patriot 3000, 4 ply, 0.077 gauge as supplied by Day International (Flint Group Print Media North America, Arden, N.C.)

The top layer solution was applied to the dried image layer using a #12 wire-wound metering rod and was then dried and cured at 158° C. (temperature set on the oven dial) to produce a dry coating weight of 1.9 g/m2. Drying and curing were also carried out on a belt conveyor oven at a speed of 3.2 feet/minute, which gives a dwell time of about 40 seconds.

Test

Sample developability was assessed by means of the GTO press. Plates were imaged at 250, 300 and 400 mJ/cm$^2$, then mounted on press, and the press was set to "on impression" for 30 seconds. This process causes the blanket to pass over the plate and remove silicone from imaged areas. After the 30 seconds, the press blanket is wiped down using isopropyl alcohol, allowed to air-dry momentarily, and normal printing begun.

Printed sheets assessed included sheets numbered 1 through 25, 50, 100 and sheet 200. The sheets were assessed for scratch-free background, finely resolved imaged features being fully clean, and a general satisfactory reproduction of the image.

Result

After 25 paper sheets were printed, subsequent sheets showed the solid areas (100% exposed areas) of the image were readable and were properly inking-in, on the plate. Samples had scratch-free backgrounds. Sheet 200 matched sheet 25 for image quality.

Example 2

This example is similar to Example 1, but uses a different image layer construction, as described in the table below. A #7 wire-rod was used to achieve a coat weight of 1.4 g/m$^2$ after being dried and cured at 138° C.

| Components | Parts by Weight Example 2 |
|---|---|
| Cymel 303 Resin | 8.21 |
| IR-T | 3.51 |
| Lubrizol 2062 | 0.08 |
| Walsroder E 400 NC | 2.85 |
| Cycat 4040 | 0.68 |
| BYK 307 | 0.21 |
| Dowanol PM | 61.77 |
| nMP | 12.69 |
| MEK | 10.000 |

IR-T is a NIR-photosensitive dye supplied by Showa Denko America, New York, N.Y. Methyl ethyl ketone is an effective dissolving agent used to help dissolve and keep the IR-T dye in solution.

Test

Samples were assessed as in Example 1, after being imaged at 250 and 300 mJ/cm$^2$, then mounted on-press.

Result

After 25 paper sheets were printed, subsequent sheet results were found to be the same as Example 1. Samples had scratch-free backgrounds. Sheet 200 matched sheet 25 for image quality.

Example 3

This example is similar to Example 1, but a lower silicone coat weight was used. A #12 wire-rod was employed to achieve a coat weight of 1.0 g/m$^2$.

| Component | Parts by Weight Example 3 |
|---|---|
| PLY-3 7500P | 6.20 |
| DC Syl Off 7367 Crosslinker | 0.265 |
| CPC 072 Pt Catalyst | 0.085 |
| Heptane | 93.45 |

Test

Samples were assessed as in Example 1, however during the imaging process, imaging speed was adjusted to 200 and 250 mJ/cm$^2$, before samples were mounted on press.

Result

After 25 paper sheets were printed, each subsequent sheet was found to have 5-10% dots (and higher) properly inked-up for the 200 mJ/cm$^2$ exposed sample and 4-5% dots (and higher) properly inked-up on the 250 mJ/cm$^2$ plate sample. Both samples had scratch-free backgrounds. Paper sheet 200 matched paper sheet 25 for image quality.

Example 4

This example used the same formulas as Example 3, however a #5 wire-rod was used to achieve a silicone dry coat weight of 0.3 g/m$^2$.

Test

Samples were assessed as in Example 3. During the press-test, 500 paper sheets were collected.

Result

After 25 paper sheets were printed, subsequent sheets were fully clean with 2-3% dots (and higher) on both the 200 and 250 mJ/cm$^2$ exposed plate samples. Both samples had scratch-free backgrounds and no wear problems were seen up to 500 impressions, when the test was curtailed. Paper sheet 500 matched paper sheet 25 for image quality.

Example 5

This example uses an imaging layer as described below. In addition, a #5 wire-rod was used to achieve a dry coat weight of 1.25 g/m$^2$ (drying accomplished at 138° C.).

| Components | Parts by Weight Example 5 |
|---|---|
| Cymel 303 Resin | 6.09 |
| S0094 NIR Dye | 5.33 |
| Walsroder E 400 NC | 2.11 |
| Cycat 4040 | 0.50 |
| BYK 307 | 0.15 |
| Dowanol PM | 67.43 |
| nMP | 18.39 |

The silicone layer used is the same as in Example 4.

Test

Samples were assessed in the manner of Example 3.

Result

After 25 paper sheets were printed, subsequent sheets were fully clean with 2-3% dots (and higher) on both the 200 and 250 mJ/cm$^2$ exposed plate samples. Both samples had scratch-free backgrounds and no wear problems up to 200 impressions. Paper sheet 200 matched paper sheet 25 for image quality.

Example 6

This example used the same formulas as in Example 1.

Test

Sample developability was assessed by means of the GTO press. Plates were imaged at 400 and 450 mJ/cm$^2$, then mounted on press, and the press was set on impression for 30 seconds. This process causes the blanket to pass over the plate and remove imaged silicone and remnant image layer. After the 30 seconds, normal printing began. There was no isopropyl alcohol wiping step, or subsequent air-drying step conducted.

Result

After 25 paper sheets were printed, subsequent sheets showed the solid areas (100% exposed areas) of the image were readable and were properly inking-in, on both imaged plate samples. Paper sheet 200 matched paper sheet 25 for image quality, for both samples.

Example 7

This example used the same formulas as in Example 4.

Test

Sample developability was assessed by means of the GTO press. Plates were imaged at 200 and 250 mJ/cm$^2$, then mounted on press, and the press was set on impression for 30 seconds. This process causes the blanket to pass over the plate and remove imaged silicone and remnant image layer. After the 30 seconds, normal printing began. There was no isopropyl alcohol wiping step, or subsequent air-drying step conducted.

Result

Results were found to be the same as Example 4. After 25 paper sheets were printed, 2-3% dots (and higher) were visible on both the 200 and 250 mJ/cm$^2$ exposed plate. Both samples had scratch-free backgrounds and no wear problems were seen up to 300 impressions, when the test was curtailed. Paper sheet 300 matched paper sheet 25 for image quality.

Comparative Example 8

This example used the same formulas as in Example 4.

Test

Sample developability was assessed by means of the GTO press. Plates were imaged at 200 and 250 mJ/cm$^2$, then mounted on press. In this example, the press inking system was activated (ink present on inking rollers, ink rollers engaged onto plate surface, no blanket cylinder engaged on plate surface) for 30 seconds, then the normal printing process began. There was no isopropyl alcohol wiping step, or subsequent air-drying step conducted.

Result

During the 30 seconds where the inking system was activated alone, the debris from plate regions imaged by the laser (mostly silicone residue) migrated through the inking system. This necessitated stopping normal printing activities to clean the press inking roller system. This is an unacceptable result and is therefore considered a failed test.

Comparative Example 9

This example used the same formulas as in Example 4.

Test

Sample developability was assessed by means of the GTO press. Plates were imaged at 200 and 250 mJ/cm$^2$, then mounted on press. In this example, the press inking system and the blanket cylinder were activated at the same time (ink present on inking rollers, ink rollers engaged onto plate surface, blanket cylinder engaged on plate surface) for 30 seconds, then the normal printing process began. There was no isopropyl alcohol wiping step, or subsequent air-drying step conducted.

Result

During the 30 seconds when the inking system and blanket cylinder were activated together, a little of the debris from plate regions imaged by the laser (mostly silicone residue) stuck to the press blanket, but most of the debris impressed back on the printing plate, leading to unacceptable, poor-quality printing. Paper sheets were not at acceptable quality. This is considered a failed test.

Example 10

This example uses an imaging layer as described below. A #10 wire-rod was used to achieve a dry coating weight of 0.7 g/m$^2$ (drying accomplished at 148° C., using the equipment described in Example 1).

| Components | Parts by Weight Example 10 |
|---|---|
| Resole HRJ 12362 | 1 |
| Micropigmo AMBK-2 | 7 |
| Cymel 385 | 0.4 |
| Cycat 4040 | 0.4 |
| BYK 307 | 0.1 |
| Dowanol PM | 91.1 |

CYMEL 385 is a methylated high imino melamine cross-linker supplied by Cytek industries, Inc. (West Paterson, N.J.). MICROPIGMO AMBK-2 is a 20% solids proprietary carbon dispersion supplied by Orient Corporation of America (Kenilworth, N.J.). Resole HRJ 12362 is a phenol formaldehyde thermosetting resin supplied as a 72 wt % solid in a 60% n-butanol solution by the SI Group, Inc. (Schenectady, N.Y.). The silicone layer used is the same as in Example 4.

Test

Samples were assessed the same as in Example 1, after being imaged at 250 and 300 mJ/cm$^2$ imaging energy density.

Result

After 25 paper sheets were printed, subsequent sheets were fully clean with all solid areas (100% exposed areas) printing on both the 250 and 300 mJ/cm$^2$ exposed plate samples. Both samples had scratch-free backgrounds. Paper sheet 200 matched paper sheet 25 for image quality.

Although the present invention has been described with reference to specific details, it is not intended that such details should be regarded as limitations upon the scope of the invention, except as and to the extent that they are included in the accompanying claims.

What is claimed is:

1. A method of printing with an ablation-type printing member comprising (i) an oleophilic substrate, (ii) over and in contact with the substrate, an ablatable imaging layer, and (iii) over and in contact with the imaging layer, a cured oleophobic polymer layer, the method comprising the steps of:

a) exposing the printing member to imaging radiation in an imagewise pattern, the imaging radiation at least partially ablating the imaging layer where exposed;

b) with the printing member on a printing press comprising (i) a plate cylinder for retaining the printing member, (ii) an inking system for transferring ink to the printing member on the plate cylinder, (iii) an impression cylinder for retaining a recording medium, and (iv) a blanket cylinder engageable to rolling contact with the plate cylinder and the impression cylinder for transferring ink from the plate to the recording medium, operating the press in an on impression mode to engage the blanket cylinder but not engage the inking system, whereby the blanket cylinder is brought into rolling contact with the uninked printing member so as to remove ablation debris therefrom and thereby create an imagewise lithographic pattern thereon, rendering the printing member suitable for printing; and c) thereafter, engaging the inking system to cause transfer of ink to the printing member and thereafter from the printing member to a recording medium, via the blanket cylinder, in the imagewise pattern.

2. The method of claim 1, wherein the blanket cylinder has a rubber surface.

3. The method of claim 1, wherein the cured oleophobic substrate is a silicone.

4. The method of claim 1, wherein the cured oleophobic substrate is a fluoropolymer.

5. The method of claim 1, further comprising the step of cleaning the blanket cylinder following step (b) but prior to step (c), followed by air drying.

6. The method of claim 1, wherein the ablatable imaging layer has (A) a single crosslinked polymer network consisting essentially of a melamine component and a resole component, the resole component being present in an amount ranging from 0% to 28% by weight of dry film, wherein the single crosslinked polymer network is the only crosslinked polymer network in the oleophilic resin composition, (B) dispersed within the crosslinked polymer network, a near-IR absorber, and (C) a dry coating weight in the range of 1.0 to 2.5 $g/m^2$.

7. The method of claim 6, wherein the imaging layer contains no resole component.

8. The method of claim 6, wherein the near-IR absorber consists essentially of a dye.

9. The method of claim 6, wherein the near-IR absorber constitutes at least 20% of the imaging layer by weight of dry film.

10. The method of claim 9, wherein the near-IR absorber constitutes at least 30% of the imaging layer by weight of dry film.

11. The method of claim 6, wherein the melamine component constitutes no more than 88% of the imaging layer by weight.

12. The method of claim 6, wherein the oleophobic layer has a dry coating weight of less than 2.0 $g/m^2$.

13. The method of claim 12, wherein the oleophobic layer has a dry coating weight of less than 0.5 $g/m^2$.

14. The method of claim 1, wherein the oleophilic substrate is an aluminum sheet.

15. The method of claim 14, wherein the aluminum is grained and anodized.

* * * * *